US010289069B2

(12) United States Patent
Nishioka et al.

(10) Patent No.: US 10,289,069 B2
(45) Date of Patent: May 14, 2019

(54) IMAGE FORMING APPARATUS

(71) Applicant: KYOCERA Document Solutions Inc., Osaka (JP)

(72) Inventors: Nobuhiro Nishioka, Osaka (JP); Yuzo Onishi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/951,849

(22) Filed: Apr. 12, 2018

(65) Prior Publication Data

US 2018/0341217 A1 Nov. 29, 2018

(30) Foreign Application Priority Data

May 23, 2017 (JP) ..... 2017-101449

(51) Int. Cl.

| | |
|---|---|
| ***G03G 21/20*** | (2006.01) |
| ***G03G 21/16*** | (2006.01) |
| ***G03G 15/00*** | (2006.01) |

(52) U.S. Cl.

CPC ..... *G03G 21/206* (2013.01); *G03G 15/751* (2013.01); *G03G 21/1633* (2013.01); *G03G 2215/00544* (2013.01); *G03G 2221/1645* (2013.01)

(58) Field of Classification Search

CPC ..... G03G 21/206; G03G 21/1633; G03G 21/1828; G03G 21/1832; G03G 15/751

See application file for complete search history.

(56) References Cited

U.S. PATENT DOCUMENTS 9,864,338 B2 * 1/2018 Yamanaka ..... G03G 21/1619

FOREIGN PATENT DOCUMENTS

| | | |
|---|---|---|
| JP | 2005-91482 A | 4/2005 |
| JP | 2010-210729 A | 9/2010 |

* cited by examiner

*Primary Examiner* — David M. Gray
*Assistant Examiner* — Andrew V Do
(74) *Attorney, Agent, or Firm* — Stein IP, LLC

(57) ABSTRACT

An image forming apparatus includes an image carrier, a developing device, a transfer section, a main body frame, a fixing device, a discharge section, a recording medium conveyance path, an openable/closable member, a cover sheet, a cover moving mechanism, a cooling section, and a slide member. The cover sheet is reciprocatable between a protection position at which it covers a side of the image carrier that faces the recording medium conveyance path and a retraction position at which it is arranged in a clearance between the image carrier and the main body frame. At the retraction position, the cover sheet blocks an air flow passage between the cooling section and the fixing device. The slide member is disposed at a lower end corner portion of the main body frame, and contacts the cover sheet reciprocating between the protection position and the retraction position.

6 Claims, 8 Drawing Sheets

IMAGE FORMING APPARATUS

INCORPORATION BY REFERENCE

This application is based upon and claims the benefit of priority from the corresponding Japanese Patent Application No. 2017-101449 filed on May 23, 2017, the entire contents of which are incorporated herein by reference.

BACKGROUND

The present disclosure relates to an electro-photographic image forming apparatus, such as a copier, a printer, a facsimile machine, and a multifunction peripheral (MFP) equipped with functions of these apparatuses, and particularly relates to an image forming apparatus which has a photosensitive member and the like near a fixing section cooled.

Conventionally, in electro-photographic image forming apparatuses such as copiers, printers, and facsimile machines, a toner image is transferred onto a sheet while the sheet is being conveyed to a photosensitive drum, the toner image is fixed on the surface of the sheet by a fixing section, and then the sheet is discharged to the outside of the apparatus. Further, for jam (sheet jam) clearance, an openable/closable body rotatably supported with respect to a main body of the apparatus is openable to allow a sheet conveyance path from the photosensitive drum to the fixing portion to be open to the outside of the main body of the apparatus.

Here, when the openable/closable body is opened, there is a risk that a surface of the photosensitive drum may be exposed to the outside of the apparatus to be exposed to external light which may cause deterioration of the photosensitive layer. In addition, there is a risk that the surface of the photosensitive drum exposed to the outside may be soiled or damaged when it is touched by a human hand or an object.

To prevent these risks, in a known configuration, a drum cover is provided which moves, along with movement of an openable/closable body, to a position at which the drum cover covers a photosensitive drum and a position at which the drum cover is retracted from a sheet conveyance path. With this configuration, when the openable/closable body is closed, the drum cover is retracted from the sheet conveyance path to allow a toner image on a surface of the photosensitive drum to be transferred onto a sheet. When the openable/closable body is opened for jam clearance, the sheet conveyance path is opened, and at the same time, the drum cover covers the surface of the photosensitive drum that faces the outside of the apparatus main body, thereby preventing exposure of the surface of the photosensitive drum to the outside of the apparatus.

In another known configuration, there is provided a cooling section for reducing exposure of an image forming unit, including a photosensitive drum, a developing device, and so on, to high temperature caused by heat from a fixing device. In this configuration, when a drum cover for protecting a surface of the photosensitive drum is retracted, the drum cover is located in an air flow generated by the cooling section.

SUMMARY

According to one aspect of the present disclosure, an image forming apparatus includes an image carrier, a developing device, a transfer section, a feeding section, a main body frame, a fixing device, a discharge section, a recording medium conveyance path, an openable/closable member, a cover sheet, a cover moving mechanism, a cooling section, and a slide member. The image carrier has an electrostatic latent image formed on a surface thereof. The developing device develops the electrostatic latent image formed on the surface of the image carrier into a toner image. The transfer section transfers the toner image formed on the surface of the image carrier onto a recording medium. The feeding section feeds the recording medium to the transfer section. The main body frame is arranged above the image carrier with a predetermined clearance therebetween. The fixing device is attached to the main body frame, and applies heat and pressure to the recording medium onto which the toner image has been transferred at the transfer section, to thereby fix the toner image on the recording medium. The discharge section discharges the recording medium on which the toner image has been fixed at the fixing device. The recording medium conveyance path conveys the recording medium from the feeding section to the discharge section. The openable/closable member is capable of opening and closing the recording medium conveyance path. The cover sheet is flexible and reciprocatable between a protection position at which the cover sheet covers a side of the image carrier that faces the recording medium conveyance path and a retraction position at which the cover sheet is arranged in the clearance between the image carrier and the main body frame. The cover moving mechanism causes the cover sheet to reciprocate between the protection position and the retraction position along with opening and closing of the openable/closable member. The cooling section generates an air flow to cool the recording medium conveyance path between the fixing device and the discharge section. The opening of the openable/closable member brings the cover sheet into the protection position, whereas the closing of the openable/closable member brings the cover sheet into the retraction position. At the retraction position, the cover sheet blocks an air flow passage between the cooling section and the fixing device. The slide member is disposed at a lower end corner portion of the main body frame, and contacts the cover sheet when the cover sheet reciprocates between the protection position and the retraction position.

Further features and advantages of the present disclosure will become apparent from the description of embodiments given below.

DETAILED DESCRIPTION

Figure 1:
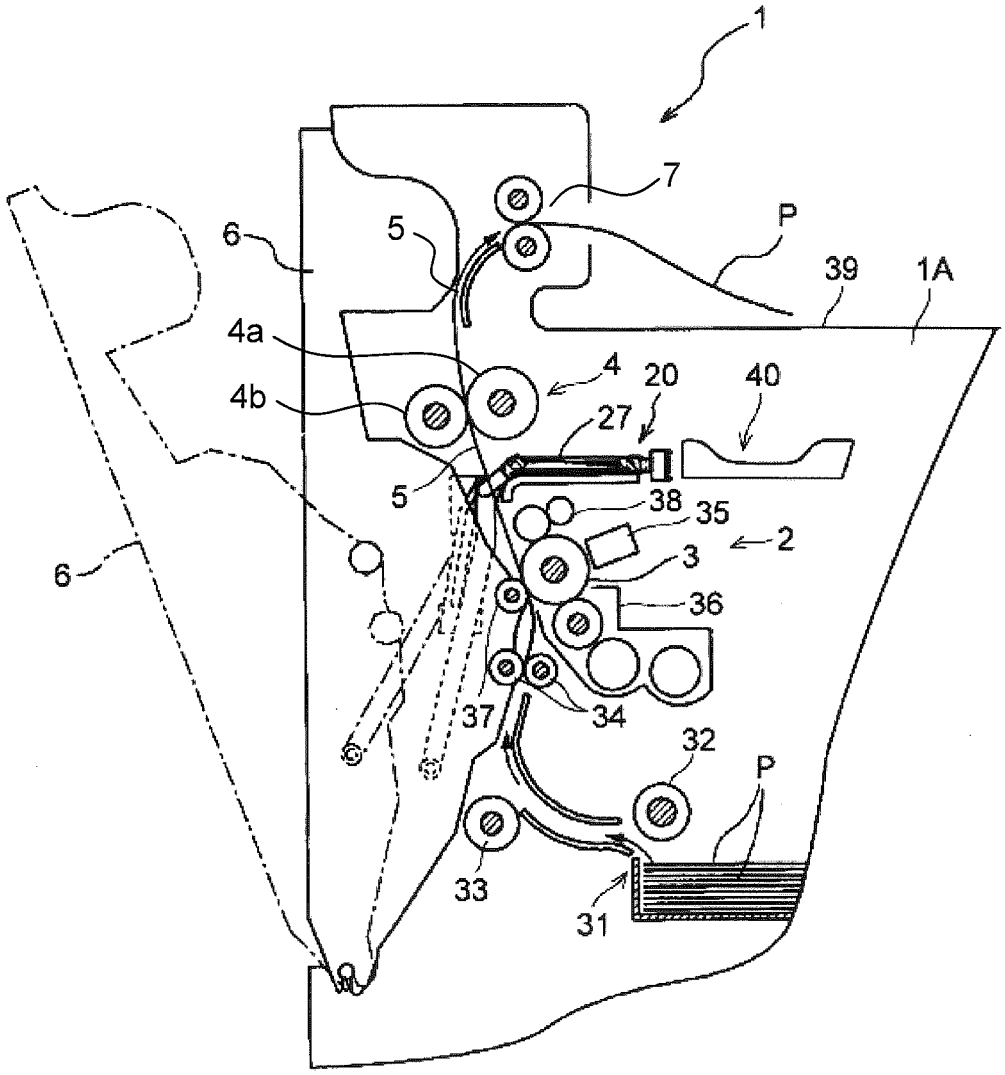
FIG. 1 is a side sectional view illustrating a principal part of an image forming apparatus according to an embodiment of the present disclosure.

Hereinafter, descriptions will be given of embodiments of the present disclosure with reference to the accompanying drawings. FIG. 1 is a side sectional view illustrating a principal part of an image forming apparatus 1 according to an embodiment of the present disclosure. The image forming apparatus 1 is a monochrome printer, and includes a sheet feeding section 31 which is disposed in a lower portion of an apparatus main body 1A, a sheet conveyance path 5 which conveys a sheet P upward from the sheet feeding section 31, an image forming section 2 which is disposed to the right of the sheet conveyance path 5, a fixing device 4 which is disposed above the image forming section 2, a cover moving mechanism 20 which is disposed around a photosensitive drum 3 of the image forming section 2, and a cooling section 40 which is disposed to the right of the cover moving mechanism 20.

The sheet feeding section 31 takes out sheets P stored in a sheet cassette one by one by the pickup roller 32 to send each sheet P into the sheet conveyance path 5. The sheet conveyance path 5 has a conveyance roller 33 and a registration roller pair 34, and conveys each sheet P sent from the sheet feeding section 31 toward the image forming section 2.

The image forming section 2 forms a predetermined toner image on the sheet P by using an electro-photographic method. The image forming section 2 has a photosensitive drum 3 which is supported to be rotatable about a shaft in a clockwise direction in FIG. 1, and further has a charger 35, a developing device 36, a transfer roller 37, a cleaning unit 38, and so on, which are arranged around the photosensitive drum 3 along the rotation direction of the photosensitive drum 3.

The charger 35 includes a charging wire to which a high voltage is applied, and a surface of the photosensitive drum 3 is uniformly charged by corona discharge from the charging wire. In the photosensitive drum 3, a photosensitive layer is formed of a photosensitive material, such as an amorphous silicon photosensitive material or an organic photosensitive material (OPC photosensitive material). When the photosensitive drum 3 is irradiated with laser light from an exposure unit (unillustrated) based on image data transmitted from a host machine such as a personal computer, the potential on the surface of the photosensitive drum 3 is selectively attenuated to form an electrostatic latent image on the surface of the photosensitive drum 3.

Next, the developing device 36 develops the electrostatic latent image on the surface of the photosensitive drum 3, and thereby a toner image is formed on the surface of the photosensitive drum 3. The toner image formed on the surface of the photosensitive drum 3 is then transferred onto the sheet P by the transfer roller 37. Residual toner remaining on the surface of the photosensitive drum 3 after the transfer is removed by the cleaning unit 38. Further, residual charge remaining on the surface of the photosensitive drum 3 is removed by a diselectrifying unit (unillustrated), such that the photosensitive drum 3 becomes ready for a next image forming operation.

The sheet P onto which the toner image has been transferred is conveyed toward the fixing device 4 arranged on a downstream side of the sheet conveyance path 5. In the fixing device 4, the sheet P receives heat and pressure by passing through a nip portion (a fixing nip portion) between a fixing roller 4*a* and a pressure roller 4*b*, and thereby the toner image is fixed onto the sheet P. Next, the sheet P having undergone the fixing process is discharged into a discharge tray 39 by a discharge roller pair 7. The sheet conveyance path 5, extending from the sheet feeding section 31 to the discharge roller pair 7, is arranged in a left-side portion of the apparatus main body 1A to extend substantially in an up-down direction.

At a left side wall of the apparatus main body 1A, an openable/closable cover 6 is disposed. The openable/closable cover 6 is openable and closable with respect to the apparatus main body 1A to clear a jam in the sheet conveyance path 5. When the openable/closable cover 6 is opened, the sheet conveyance path 5 is separated into a portion on the apparatus main body 1A side and a portion on the openable/closable cover 6 side, making it possible to remove a sheet stuck in the sheet conveyance path 5.

The openable/closable cover 6 has a lower end portion thereof supported on a shaft such that the openable/closable cover 6 is rotatable with respect to the apparatus main body 1A. By operating the openable/closable cover 6 to swing about the shaft, it is possible to switch between an opening state in which an opening is formed between the apparatus main body 1A and the openable/closable cover 6 (the state indicated by the dashed dotted line in FIG. 1) and a closing state in which the openable/closable cover 6 tightly closes the apparatus main body 1A. When the openable/closable cover 6 is in the closing state, an image forming operation is allowed to be performed, but when the openable/closable cover 6 is in the opening state, the cover moving mechanism 20, which will be described later, causes the cover sheet 27 to move from a position over the photosensitive drum 3 to a position to the left of the photosensitive drum 3. This helps prevent damage to the surface of the photosensitive drum 3 which might be caused when an operator opens the openable/closable cover 6 for jam clearance and touches the photosensitive drum 3 with his/her hand, a tool, and so on.

Figure 2:
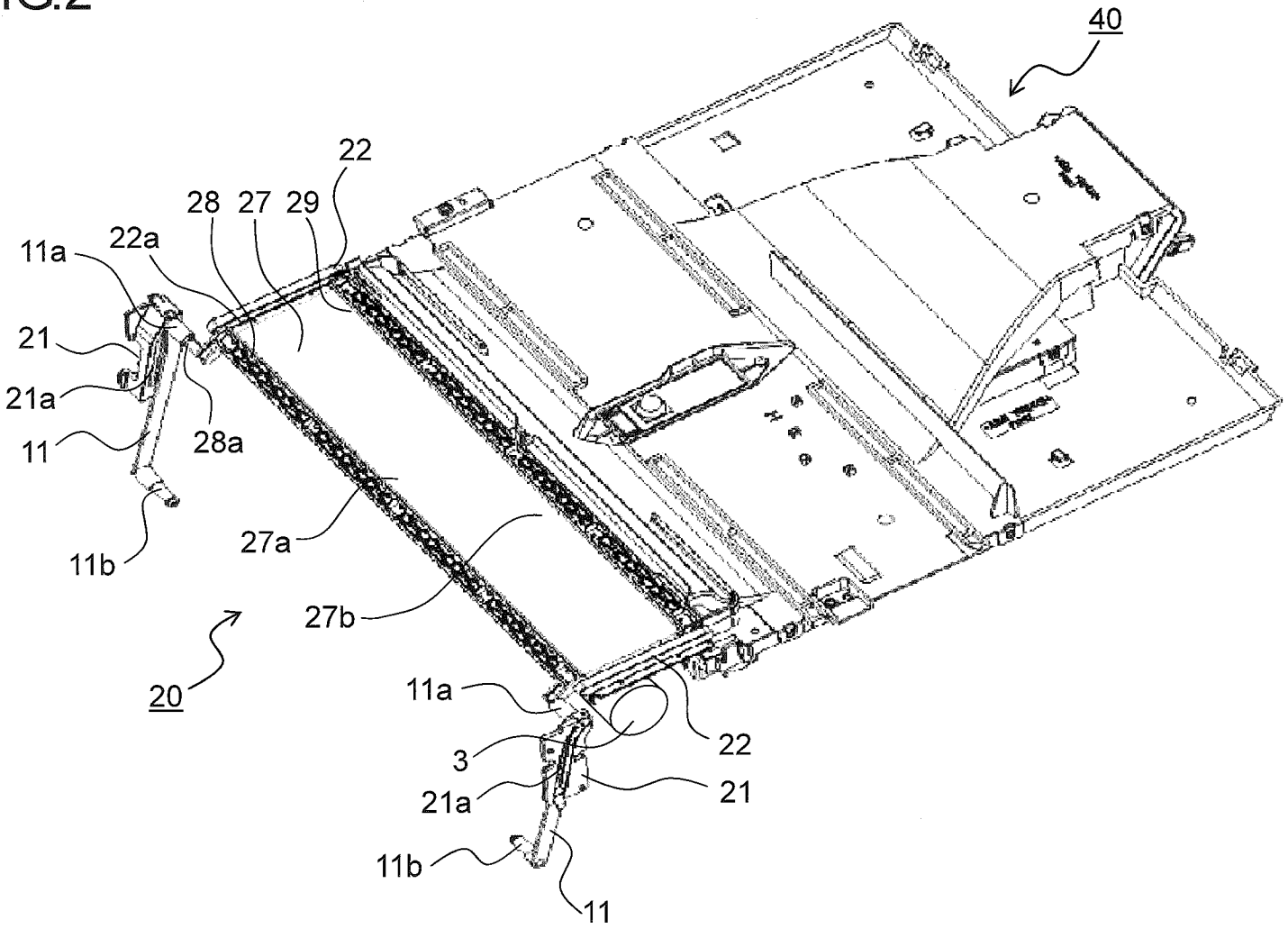
FIG. 2 is a perspective view illustrating a cover moving mechanism in the image forming apparatus of the present embodiment, showing a state where an openable/closable cover is closed.
Figure 3:
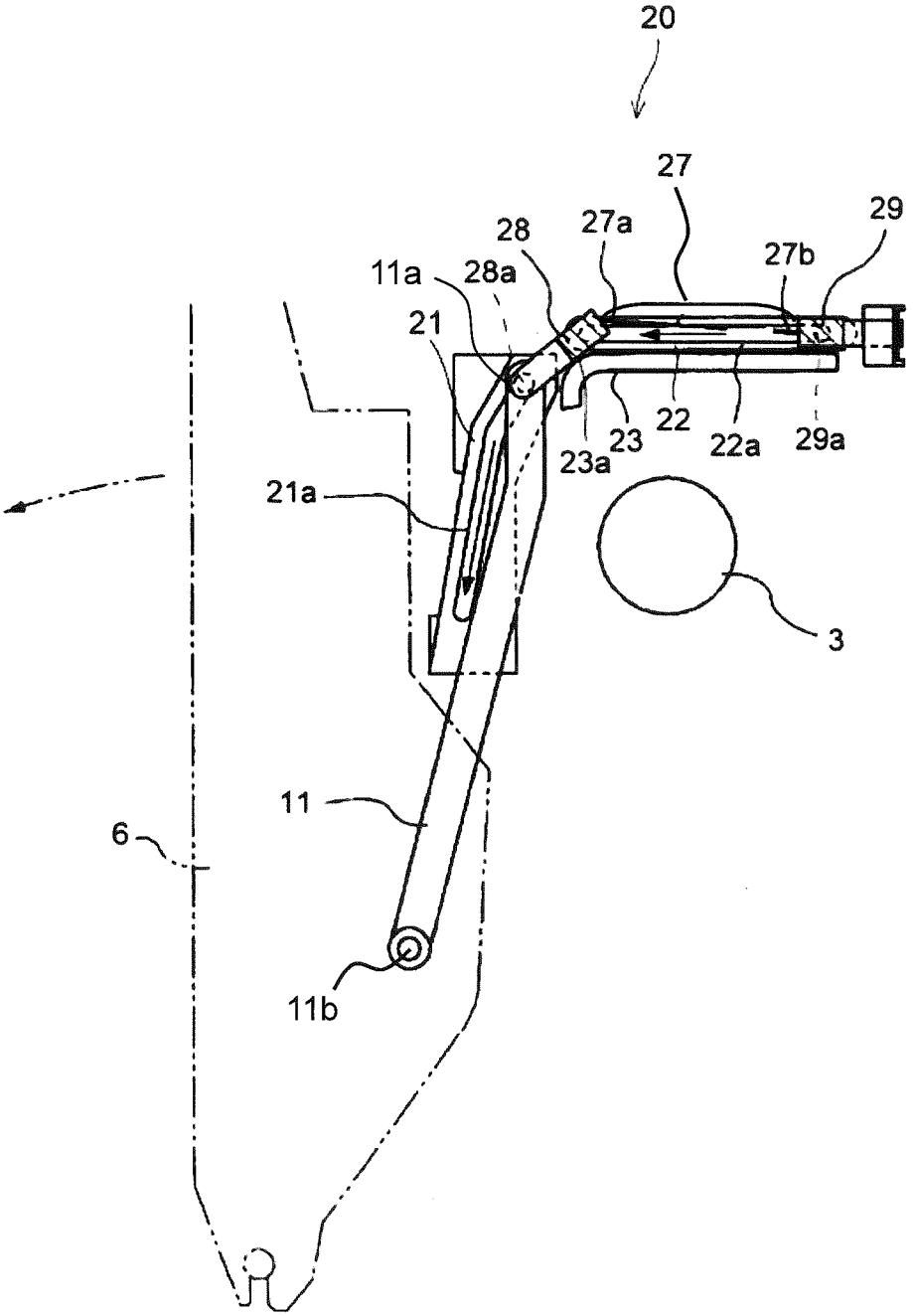
FIG. 3 is a side sectional view illustrating the cover moving mechanism in the image forming apparatus of the present embodiment, showing a state where the openable/closable cover is closed.

FIG. 2 is a perspective view illustrating the cover moving mechanism 20 with the openable/closable cover 6 closed (during an image forming operation), and FIG. 3 is a side sectional view illustrating the cover moving mechanism 20 with the openable/closable cover 6 closed. A detailed description will now be given of the cover moving mechanism 20, which causes the cover sheet 27 to move, with reference to FIG. 2 and FIG. 3.

As illustrated in FIG. 2, the cover moving mechanism 20 includes the cover sheet 27, a first sheet holder 28 and a second sheet holder 29, which support the cover sheet 27, arm rails 21, holder rails 22, and a sheet guide 23 (see FIG. 3).

The cover sheet 27 is a flexible sheet member made of a high molecular weight polyethylene, and has a front surface thereof (a surface thereof that does not face the photosensitive drum 3) coated with a heat reflective film and thus has thermal insulation properties. A length of the cover sheet 27 in its width direction (an axial direction of the photosensitive drum 3) is set to be equal to or greater than a length of the photosensitive drum 3 in its axial direction. A length of the cover sheet 27 in its moving direction in which the cover sheet 27 moves (a left-right direction in FIG. 2 and an up-down direction in FIG. 3) is set to be approximately twice as long as an outer diameter of the photosensitive drum 3. When the openable/closable cover 6 is in the closing state, the cover sheet 27 is arranged over the photosensitive drum 3.

The first sheet holder 28 fixedly supports a front edge 27*a* of the cover sheet 27 substantially over an entire width of the cover sheet 27. The second sheet holder 29 fixedly supports a rear edge 27*b* of the cover sheet 27 substantially over the entire width of the cover sheet 27. The first sheet holder 28 is provided with a pair of first engagement bosses 28*a*, which are arranged one at each end portion of the first sheet holder 28 in its longitudinal direction. The second sheet holder 29 is provided with a pair of second engagement bosses 29*a*, which are arranged one at each end portion of the second sheet holder 29 in its longitudinal direction.

The apparatus main body 1A has fixedly disposed thereon the arm rails 21 and the holder rails 22, which are respectively paired with each other in a width direction of the cover sheet 27. Vertical rail grooves 21*a* are formed one in each of the arm rails 21 to extend substantially in the up-down direction, and lateral rail grooves 22*a* are formed one in each of the holder rails 22 to extend substantially in a horizontal direction.

The first engagement bosses 28*a*, which are formed one at each end portion of the first sheet holder 28, are swingably coupled to swing shafts 11*a*, which are formed one at an upper end portion of each of a pair of link arms 11. The swing shafts 11*a* slidably engage with the vertical rail grooves 21*a* formed in the arm rails 21. The link arms 11 are swingably supported on the openable/closable cover 6 by swing fulcra 11*b* formed one at a lower end portion of each of the link arms 11. The first sheet holder 28 is movable together with the openable/closable cover 6 via the link arms 11.

The second engagement bosses 29*a*, which are formed one at each end portion of the second sheet holder 29, are slidably engaged with the lateral rail grooves 22*a*, which are formed one in each of the pair of holder rails 22.

The sheet guide 23 is disposed between the pair of holder rails 22. The sheet guide 23 horizontally extends along the lateral rail grooves 22*a* so as to face a lower surface of the cover sheet 27, and further, the sheet guide 23 has an arc-shaped bent portion 23*a* formed at a left end (on the arm rails 21 side) thereof. When the first sheet holder 28 moves in the up-down direction and the second sheet holder 29 moves in the horizontal direction, the cover sheet 27, which is supported by the first sheet holder 28 and the second sheet holder 29, is guided along the bent portion 23*a* of the sheet guide 23 to move along an arc trajectory surrounding the photosensitive drum 3.

Figure 4:
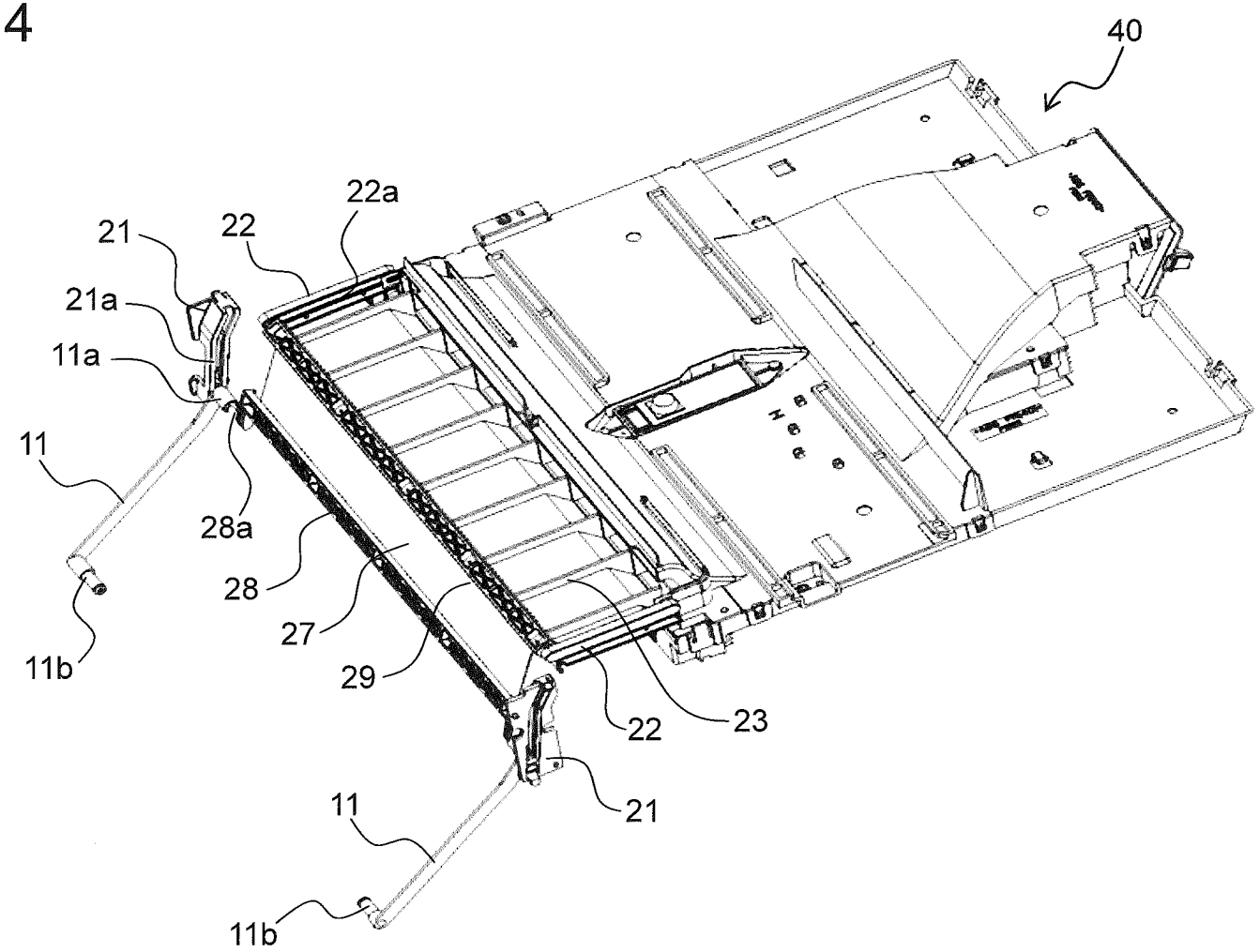
FIG. 4 is a perspective view illustrating the cover moving mechanism in the image forming apparatus of the present embodiment, showing a state where the openable/closable cover is opened.
Figure 5:
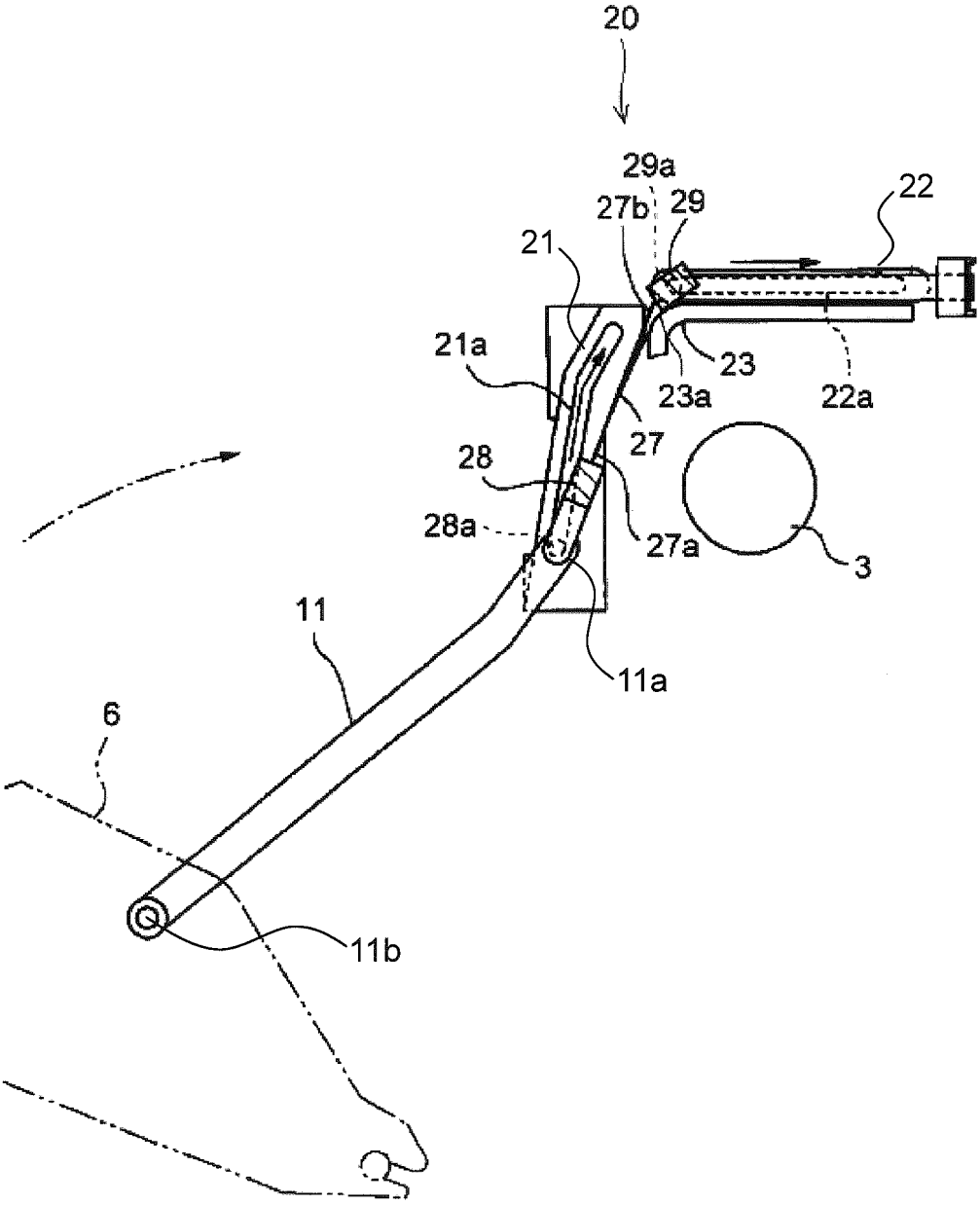
FIG. 5 is a side sectional view illustrating the cover moving mechanism in the image forming apparatus of the present embodiment, showing a state where the openable/closable cover is opened.

FIG. 4 is a perspective view illustrating the cover moving mechanism 20 in a state where the openable/closable cover 6 is opened, and FIG. 5 is a side sectional view illustrating the cover moving mechanism 20 in a state where the openable/closable cover 6 is opened. With reference to FIGS. 2 and 3, and FIGS. 4 and 5, a description will be given of an operation of moving the cover sheet 27 performed by the cover moving mechanism 20.

In the state where the openable/closable cover 6 is closed, the cover sheet 27 is arranged, as illustrated in FIGS. 2 and 3, at a position above the photosensitive drum 3 but below the fixing device 4 (see FIG. 1) (hereinafter, referred to as a retraction position). Note that the length of the cover sheet 27 in its moving direction (the left-right direction in FIG. 3) is longer than a length from upper end portions of the vertical rail grooves 21*a* (the position of the first sheet holder 28 when the cover sheet 27 is at the retraction position) to right end portions of the lateral rail grooves 22*a* (the position of the second sheet holder 29 when the cover sheet 27 is at the retraction position), and thus, at the retraction position, the cover sheet 27 is in a bent state. Here, since the sheet guide 23 exists below the cover sheet 27, the cover sheet 27 is in an upwardly bent state as illustrated in FIG. 3.

When the openable/closable cover 6 is moved to rotate in an opening direction as indicated by the dashed double-dotted line arrow in FIG. 3 from the state where it is closed, the link arms 11 move together with the openable/closable cover 6, and the swing shafts 11*a* move from the upper end portions of the vertical rail grooves 21*a* in a direction indicated by a solid line arrow in FIG. 3. Along with this, the first sheet holder 28, which is coupled to the swing shafts 11*a* of the link arms 11, also moves downward along the vertical rail grooves 21*a*.

Along with the movement of the first sheet holder 28, the second sheet holder 29 is also caused, via the cover sheet 27, to move in the direction indicated by another solid line arrow in FIG. 3, from the right end portions of the lateral rail grooves 22*a* to the left side. Thereby, the cover sheet 27 is guided along the sheet guide 23, while being stretched from the bent state, and moves, at the bent portion 23*a*, along an arc trajectory surrounding the photosensitive drum 3, to be arranged at a position at which it covers a portion of photosensitive drum 3 on the side of the sheet conveyance path 5 (hereinafter, referred to as a protection position).

When the openable/closable cover 6 in an opened state is moved to rotate in a closing direction as indicated by the dashed double-dotted line arrow in FIG. 5, the link arms 11 move together with the openable/closable cover 6, and the swing shafts 11*a* move from lower end portions of the vertical rail grooves 21*a* in a direction indicated by a solid line arrow in FIG. 5. Along with this, the first sheet holder 28, which is coupled to the swing shafts 11*a* of the link arms 11, also moves upward along the vertical rail grooves 21*a*. Along with the upward movement of the first sheet holder 28, force in a compression direction is applied to the cover sheet 27 between the first sheet holder 28 and the second sheet holder 29. As a result, the second sheet holder 29 is pushed by restoration force (elastic force) of the cover sheet 27, and moves along the lateral rail grooves 22*a* in a direction (a rightward direction) as indicated by another solid line arrow in FIG. 5. Then, the cover sheet 27 is guided along the sheet guide 23 in the stretched state until the second sheet holder 29 reaches the right end portions of the lateral rail grooves 22*a*, and at the bent portion 23*a*, the cover sheet 27 moves along an arc trajectory surrounding the photosensitive drum 3.

Here, the link arms 11 continue to rotate even after the second sheet holder 29 reaches the right end portions of the lateral rail grooves 22*a* and stops moving, and the swing shafts 11*a* move toward the upper end portions of the vertical rail grooves 21*a*. As a result, a distance between the first sheet holder 28 and the second sheet holder 29 becomes shorter than a length of the cover sheet 27 in its moving direction, and thus the cover sheet 27 moves, while being bent, to a position above the photosensitive drum 3, and returns to the retraction position indicated in FIG. 2 and FIG. 3.

Figure 6:
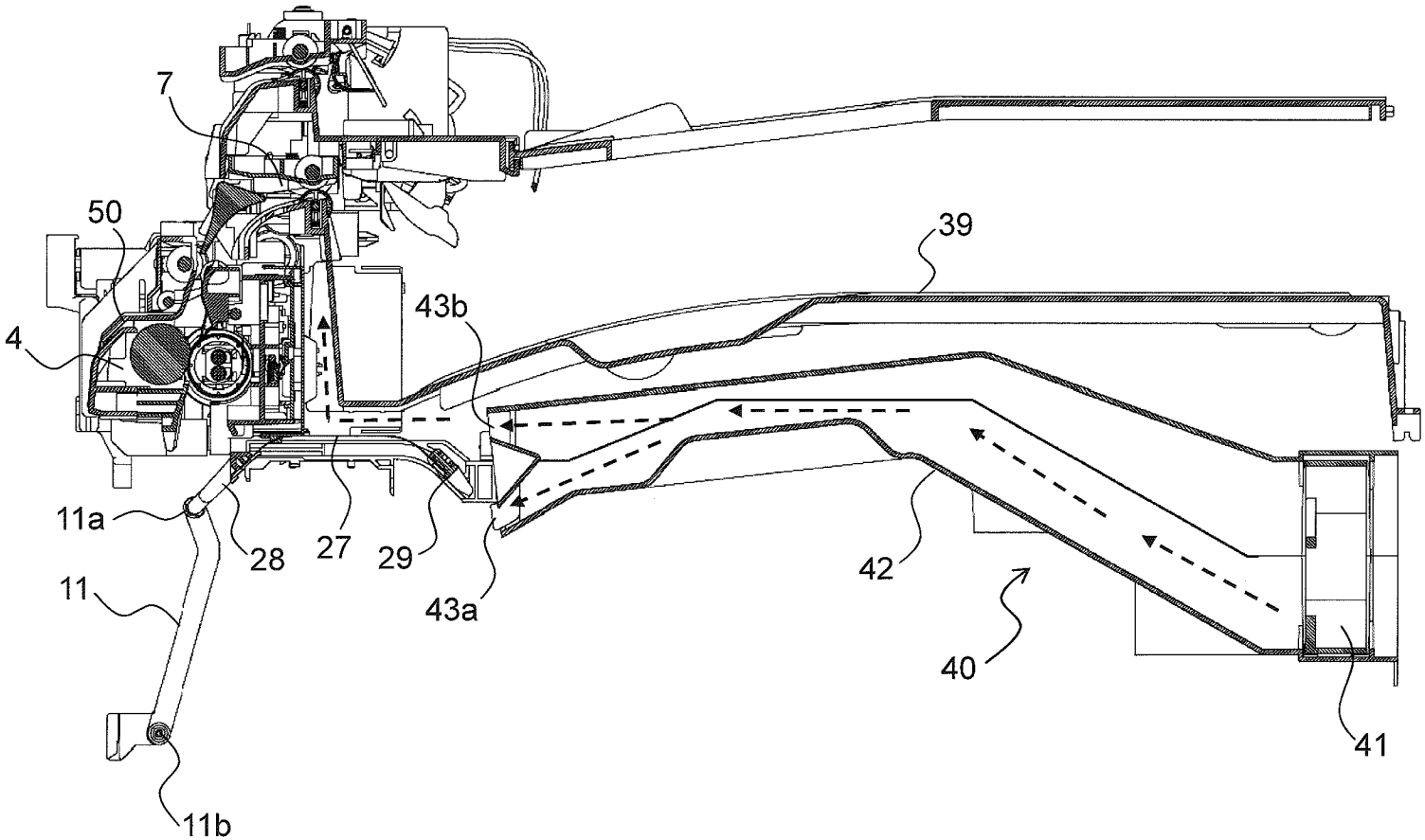
FIG. 6 is a side sectional view illustrating a configuration of an area around a cooling section of the image forming apparatus of the present embodiment.
Figure 7:
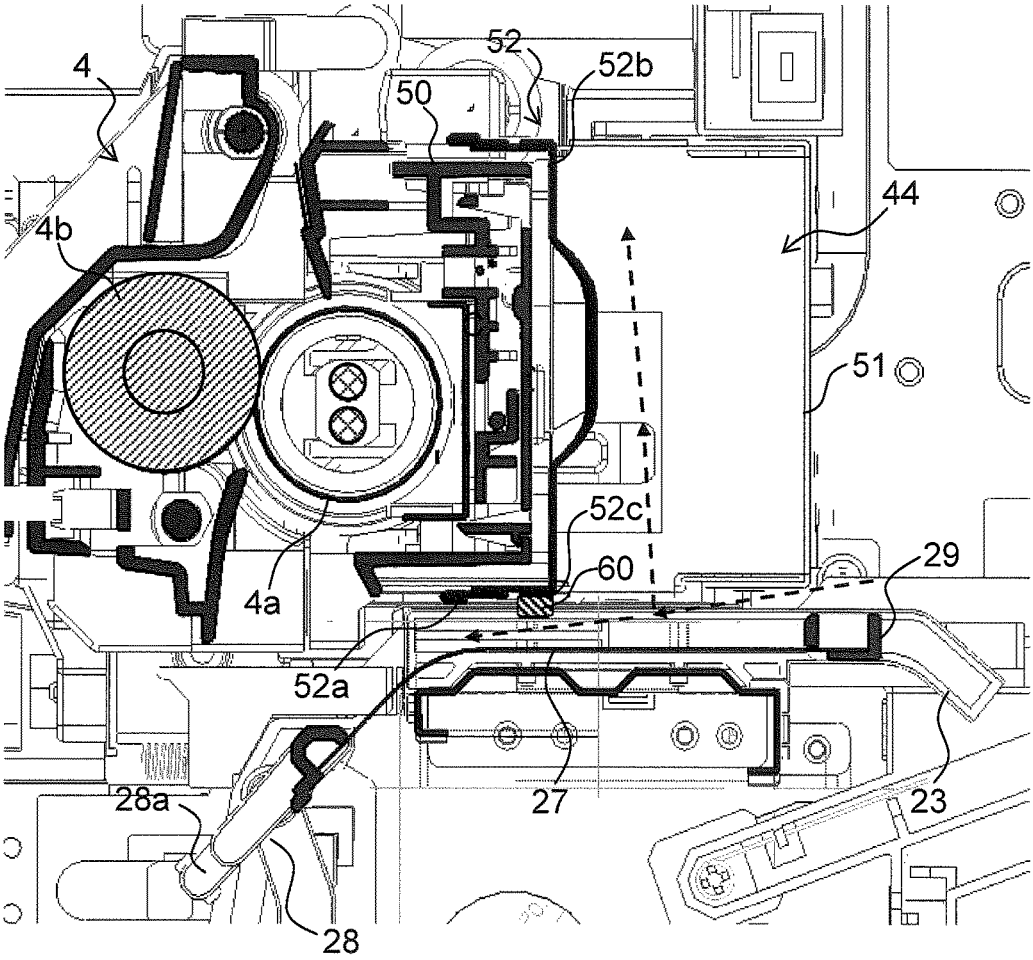
FIG. 7 is an enlarged view of an area around an outlet of a first duct illustrated in FIG. 6, showing a state where the cover sheet is arranged between a retraction position and a protection position.
Figure 8:
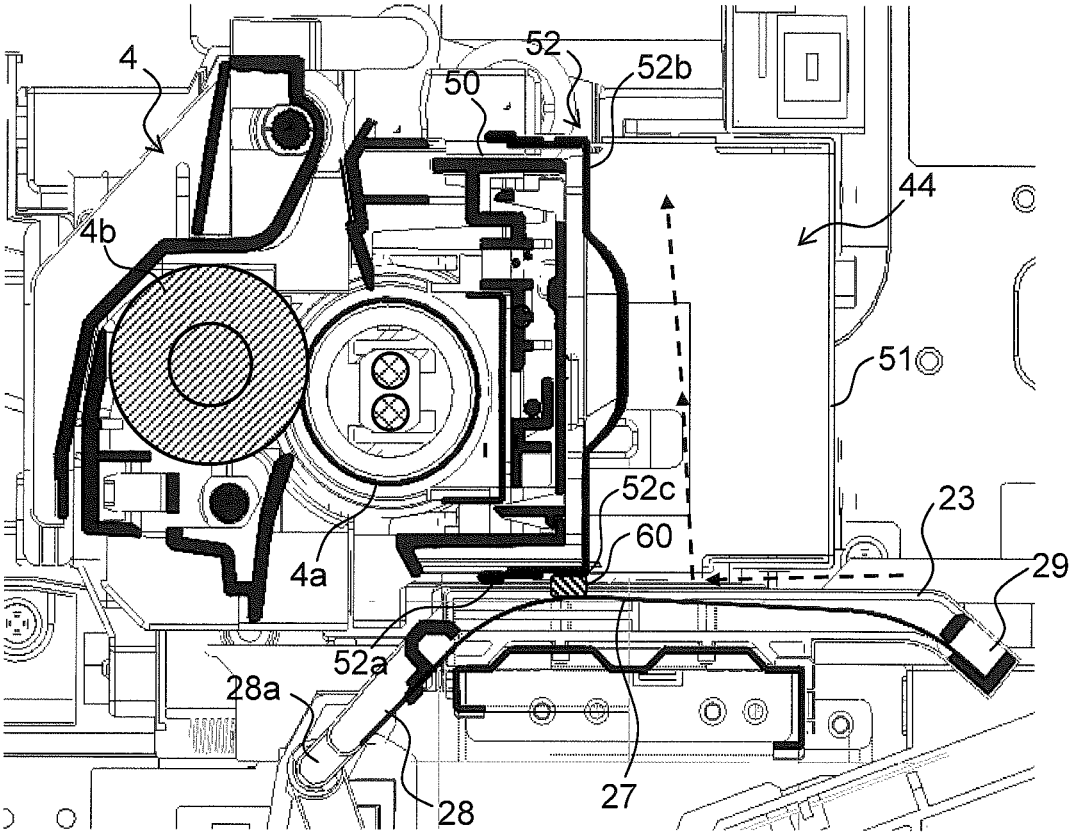
FIG. 8 is an enlarged view of an area around the outlet of the first duct illustrated in FIG. 6, showing a state where the cover sheet is arranged at the retraction position.

FIG. 6 is a side sectional view illustrating a configuration of an area around a cooling section 40 of the image forming apparatus 1, and FIG. 7 and FIG. 8 are each an enlarged view of an area around outlets 43*a* and 43*b* of a first duct 42 illustrated in FIG. 6. FIG. 7 illustrates a state where the cover sheet 27 is arranged between the retraction position and the protection position, and FIG. 8 illustrates a state where the cover sheet 27 is arranged at the retraction position. Descriptions will be given of an arrangement and a configuration of the cooling section 40, with reference to FIG. 1, FIG. 2, and FIG. 6 to FIG. 8.

As illustrated in FIG. 1 and FIG. 2, the cooling section 40 is disposed behind the sheet conveyance path 5 as viewed from the openable/closable cover 6 side. The cooling section 40 is provided for the purpose of cooling an object to which heat from the fixing device 4 is transferred, such as an image forming unit including the photosensitive drum 3, the developing device 36, the cleaning unit 38, and so on, and a sheet P which is conveyed through the sheet conveyance path 5 after passing through the fixing device 4.

As illustrated in FIG. 6 to FIG. 8, the cooling section 40 includes a blower fan 41, the first duct 42, and a second duct 44. The blower fan 41 is an air intake fan which takes in air from outside the apparatus main body 1A. Air taken in via the blower fan 41 flows through the first duct 42, such that a part of the air flows to the first outlet 43*a*, and another part of the air flows to the second outlet 43*b*.

An air flow discharged through the first outlet 43*a* passes below the cover sheet 27, and reaches the photosensitive drum 3, the developing device 36, the cleaning unit 38, and so on, and cools these units. Thereby, is possible to alleviate flowability deterioration of toner in the developing device 36 and that of exhaust toner in the cleaning unit 38, both caused by the heat from the fixing device 4.

An air flow discharged through the second outlet 43*b* passes above the cover sheet 27, then flows upward through the second duct 44, which is formed between a side surface 52*b* of a main body frame 52 and an inner wall surface 51 of the apparatus main body 1A, a housing 50 of the fixing device 4 being attached to the main body frame 52, and then the air flow reaches the sheet conveyance path 5 connecting the fixing device 4 and the discharge roller pair 7. Thereby, it is possible to cool a sheet conveyed through the fixing device 4 toward the discharge roller pair 7, and to cool toner fused with heat from the fixing roller 4*a*, to thereby reduce adhesion of toner to the sheet conveyance path 5 or to the discharge roller pair 7. When a sheet that has absorbed moisture passes through the fixing device 4, the moisture is evaporated by the heat from the fixing device 4, and sometimes rises up into the atmosphere as steam, which a user may mistake for smoke. Here, however, the air flow sent through the second duct 44 to the sheet conveyance path 5 scatters the steam, and this eliminates the risk that the user will mistakenly recognize the steam as smoke.

In the present embodiment, as illustrated in FIG. 8, when the cover sheet 27 is arranged at the retraction position, the clearance between the cover sheet 27 and a lower end portion 52*a* of the main body frame 52 is closed by the upward bend of the cover sheet 27. In this state, the air flow discharged through the second outlet 43*b* is not allowed to flow toward the fixing roller 4*a*, but is efficiently guided to the sheet conveyance path 5 by passing above the second duct 44, which is formed between the side surface 52*b* of the main body frame 52 and the inner wall surface 51 of the apparatus main body 1A.

Accordingly, it is possible to effectively cool a sheet passing through the fixing device 4 to be conveyed to the discharge roller pair 7, and thus to reduce stains on the sheet conveyance path 5 and the discharge roller pair 7 resulting from fused toner adhering to them. Since the air flow discharged through the second outlet 43*b* is not allowed to flow toward the fixing roller 4*a*, it is possible to reduce power loss caused if the fixing roller 4*a* is cooled.

As illustrated in FIG. 7, a slide member 60 is fixed to a lower end corner portion 52*c* of the main body frame 52, the lower end corner portion 52*c* facing the cover sheet 27. The slide member 60 faces the cover sheet 27 over the entire range of the cover sheet 27 in a width direction of the cover sheet 27 (a direction orthogonal to the surface of the sheet on which FIG. 7 is drawn). Along with a closing operation of the openable/closable cover 6, the cover sheet 27 is caused by the cover moving mechanism 20 to bend upward, such that the slide member 60 slides on the front surface (the surface that does not face the photosensitive drum 3) of the cover sheet 27 as illustrated in FIG. 8. Thereby, contact is avoided between the cover sheet 27 and the lower end corner portion 52*c* of the main body frame 52, and thus, it is possible to effectively prevent problems that would otherwise result from the cover sheet 27 contacting the lower end corner portion 52*c*, such as flawing or shaving of the cover sheet 27, sliding noise, and staining of the inside of the image forming apparatus 1 with shavings of the cover sheet 27. Used as the material of the slide member 60 is a material having flexibility (cushioning properties) that is, an elastically deformable material, such as sponge, nonwoven fabric, and so on. In the present embodiment, a foamed melamine resin (Basotect G+, a product of INOAC CORPORATION) is used.

A length of the slide member 60 in its longitudinal direction (a direction orthogonal to surfaces of the sheets on which FIG. 7 and FIG. 8 are drawn) is greater than a length of the cover sheet 27 in its width direction. Accordingly, the slide member 60 slides on the entire front surface (the surface that does not face the photosensitive drum 3) of the cover sheet 27, and thus stains of materials such as paper powder, toner, and the like on the front surface of the cover sheet 27 are automatically removed. That is, the slide member 60 functions also as a cleaning member for cleaning the front surface of the cover sheet 27 when the cover sheet 27 reciprocates between the protection position and the retraction position, and this helps keep a clean appearance of the cover sheet 27 which is visible to an operator when he or she opens the openable/closable cover 6.

Further, since the slide member 60 is formed of an elastically deformable material having flexibility, when in contact with each other as illustrated in FIG. 8, the cover sheet 27 and the slide member 60 contact each other with improved adhesion. As a result, it becomes less likely for a gap to be left above the cover sheet 27 than in a configuration where the cover sheet 27 and the lower end portion 52*a* of the main body frame 52 directly contact each other. Accordingly, it is possible to effectively block the passage of the air flow flowing from the second outlet 43*b* toward the fixing roller 4*a*.

The embodiments described above are in no way meant to limit the present disclosure, which thus allows for many modifications and variations within the spirit of the present disclosure. For example, in the example dealt with in the above-described embodiment, the blower fan 41 is constituted by an intake fan, but this is not meant to limit the present disclosure. The blower fan 41 may be constituted by a discharge fan such that heat around the photosensitive drum 3, the developing device 36, and the cleaning unit 38 and heat around the sheet conveyance path 5 is discharged by the blower fan 41 to the outside of the apparatus main body 1A through the first duct 42.

Further, in the example dealt with in the above-described embodiment, the first duct 42 has two branch outlets, namely, the first outlet 43*a* and the second outlet 43*b*, but this is note meant to limit the present disclosure, and the first duct 42 may have three or more branch outlets.

Further, the application of the present disclosure is not limited to monochrome printers like the one illustrated in FIG. 1, but the present disclosure is applicable to various image forming apparatuses, such as color printers, monochrome and color copiers, facsimile machines, and so on, which are provided with a drum cover for protecting a photosensitive drum.

The present disclosure is usable in electro-photographic image forming apparatuses, such as copiers, printers, facsimile machines, and multifunction peripherals equipped with the functions of these apparatuses. By using the present disclosure, it is possible to provide an image forming apparatus that is capable of controlling the flow of cooling air by using a protection cover that protects an image carrier to thereby efficiently cool a recording medium that has passed through the fixing device, and that is also capable of reducing power loss in the fixing device.

What is claimed is:

1. An image forming apparatus comprising:

an image carrier on a surface of which an electrostatic latent image is formed;

a developing device which develops the electrostatic latent image formed on the surface of the image carrier into a toner image;

a transfer section which transfers the toner image formed on the surface of the image carrier onto a recording medium;

a feeding section which feeds the recording medium to the transfer section;

a main body frame which is arranged above the image carrier with a predetermined clearance therebetween;

a fixing device which is attached to the main body frame, and which applies heat and pressure to the recording medium to which the toner image has been transferred at the transfer section, to thereby fix the toner image on the recording medium;

a discharge section which discharges the recording medium on which the toner image has been fixed at the fixing device;

a recording medium conveyance path which conveys the recording medium from the feeding section to the discharge section;

an openable/closable member which is capable of opening and closing the recording medium conveyance path;

a cover sheet which is flexible and reciprocatable between a protection position at which the cover sheet covers a side of the image carrier that faces the recording medium conveyance path and a retraction position at which the cover sheet is arranged in the clearance between the image carrier and the main body frame;

a cover moving mechanism which causes the cover sheet to reciprocate between the protection position and the retraction position along with opening and closing of the openable/closable member;

a cooling section which generates an air flow to cool the recording medium conveyance path between the fixing device and the discharge section; and a slide member which is disposed at a lower end corner portion of the main body frame and contacts the cover sheet when the cover sheet reciprocates between the protection position and the retraction position, wherein the opening of the openable/closable member brings the cover sheet into the protection position, whereas the closing of the openable/closable member brings the cover sheet into the retraction position, and the cover sheet arranged at the retraction position blocks an air flow passage between the cooling section and the fixing device.

2. The image forming apparatus according to claim 1, wherein a length of the slide member in a longitudinal direction of the slide member is greater than a length of the cover sheet in a width direction of the cover sheet, the width direction of the cover sheet being orthogonal to a moving direction of the cover sheet.

3. The image forming apparatus according to claim 2, wherein the slide member functions also as a cleaning member which cleans a front surface of the cover sheet when the cover sheet reciprocates between the protection position and the retraction position.

4. The image forming apparatus according to claim 1, wherein the slide member is formed of an elastically deformable material.

5. The image forming apparatus according to claim 1, wherein the cover moving mechanism includes a first sheet holder which holds one edge of the cover sheet in a moving direction of the cover sheet, a second sheet holder which holds another edge of the cover sheet in the moving direction of the cover sheet, a pair of link arms each including a swing shaft to which an end portion of the first sheet holder is rotatably coupled, and a swing fulcrum which is rotatably supported on the openable/closable member, a pair of arm rails which each slidably support the swing shaft of one of the link arms, and a pair of holder rails which slidably support opposing end portions of the second sheet holder, and wherein, when the cover sheet is moved to the retraction position, a distance between the first sheet holder and the second sheet holder becomes shorter than a length of the cover sheet in the moving direction of the cover sheet, such that the cover sheet is bent and contacts the main body frame.

6. The image forming apparatus according to claim 1, wherein the cooling section includes a blower fan which generates an air flow, a first duct which guides the air flow generated by the blower fan to the fixing device, and a second duct which guides the air flow, which has been guided by the first duct, from a contact portion, at which the cover sheet contacts the main body frame, to the recording medium conveyance path between the fixing device and the discharge section.

* * * * *